United States Patent [19]

Maki

[11] 3,972,078

[45] Aug. 3, 1976

[54] DRAIN SIEVE

[75] Inventor: George A. Maki, North Hollywood, Calif.

[73] Assignee: George A. Maki, North Hollywood, Calif.

[22] Filed: Sept. 24, 1975

[21] Appl. No.: 616,324

[52] U.S. Cl. ..... 4/287; 4/292; 4/295; 210/163

[51] Int. Cl.[2] ..... A47K 1/14

[58] Field of Search ..... 4/287, 288, 285, 290, 4/292, 289; 210/163, 164, 165; 239/590

[56] References Cited

UNITED STATES PATENTS

| | | | |
|---|---|---|---|
| 594,169 | 11/1897 | Catsiff | 4/287 |
| 659,514 | 10/1900 | Duffy | 4/287 |
| 1,118,235 | 11/1914 | Rock | 4/286 |
| 1,122,745 | 12/1914 | Hall | 4/287 |
| 3,082,957 | 3/1963 | Sample | 239/204 |
| 3,314,085 | 4/1967 | Minella | 4/288 |
| 3,453,667 | 7/1969 | Politz | 4/295 |

*Primary Examiner*—Henry K. Artis
*Attorney, Agent, or Firm*—Poms, Smith, Lande & Glenny

[57] ABSTRACT

A device protects against inadvertent loss of objects down drain pipes when the associated drain stopper is in an opened position. The associated stopper includes a top closure portion, an intermediate guide portion and a bottom actuated means for moving the top closure portion between opened and closed positions relative to a drain fitting which has a flange surrounding a drain bore in which said intermediate guide portion travels. The device for protecting against inadvertent loss comprises screening means of toroidal configuration for mounting about the stopper adjacent and below the top closure portion. The screening means rides on the intermediate guide portion into the drain bore upon closure of the stopper and, out of the drain bore upon opening of the stopper. The screening means fills a toroidal zone substantially between the outer marginal underside areas of the top closure portion and an upper inner area of the drain fitting flange, whereby the drain bore is screened against the loss of objects therethrough when the stopper is in an opened position.

4 Claims, 4 Drawing Figures

DRAIN SIEVE

BACKGROUND OF THE INVENTION

This invention relates in general to plumbing fixtures having stoppered drains. The invention relates specifically to a device which may be attached to the stopper of a plumbing fixture to prevent the inadvertent loss of objects down the drain bore.

Devices for preventing loss down plumbing fixture drains are old, as are spring devices for the prevention of loss of solid objects down a drain.

In Keech, U.S. Pat. No. 335,363 (1886), and Gage, U.S. Pat. No. 313,068 (1885), a coil spring is placed within the drain bore to obstruct the passage of non-liquid waste.

It should be noted that, as the protector was within the drain bore in both cases, an object was allowed to enter the drain bore and was then stopped. This necessitated the removal of the device and the lost object from the drain bore. Any erratic motion while removing the protector from the drain could cause the objects trapped by the protector to be dislodged and fall into the drain bore.

Further protective devices were attached to the stopper itself, Gessler U.S. Pat. No. 1,203,530 (1916), but again, the protector was disposed within the drain bore during operation.

SUMMARY OF THE INVENTION

An object of the present invention is to disclose and provide a device for prohibiting solid material from entering plumbing fixture drain bores. It is a further object of the present invention to disclose and provide a device for preventing loss down plumbing fixture drain bores, which operates outside the drain bore itself. It is a still further object of the present invention to disclose and provide a device for preventing loss down plumbing fixture drain bores, which is coordinated in operation with the plumbing fixture stopper.

The various advantages and improvements of the present invention in drain bore protective devices, as well as a better understanding thereof, will be obtained by those skilled in the art from a consideration of the following detailed description of an exemplary embodiment of the present invention. Reference will be made to the appended sheets of drawings which will be described briefly before the detailed description of an exemplary embodiment.

DETAILED DESCRIPTION OF AN EXEMPLARY EMBODIMENT

Figure 1:
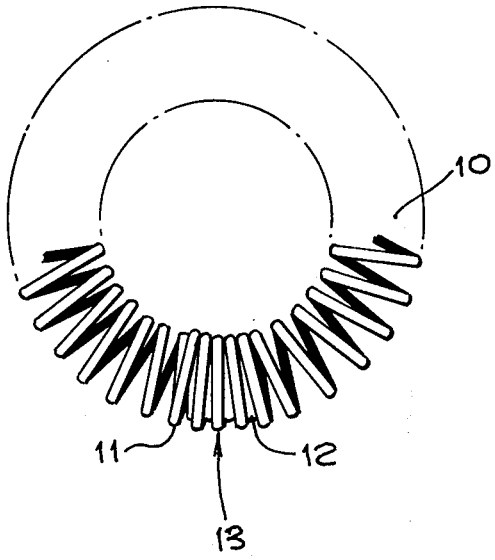
FIG. 1 is a perspective view of the device in the form of a coil spring toroid.
Figure 2:
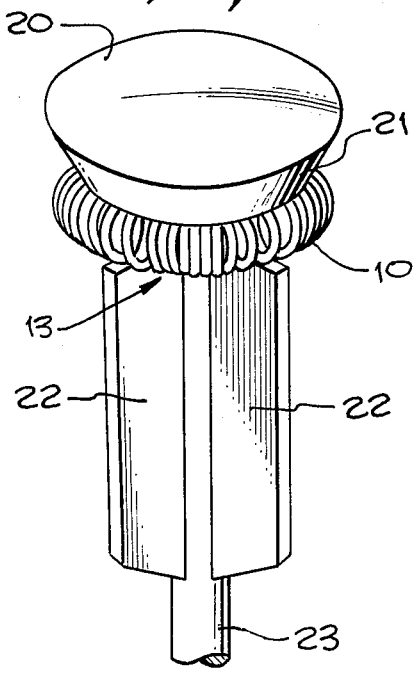
FIG. 2 is a perspective view of the device installed on a plumbing fixture stopper.

Referring first to FIG. 1, a device shown generally at 10, protects against an inadvertent loss of objects down drain pipes when assembled to and associated with a stopper 20, as shown in FIG. 2. The stopper has a top closure portion 21, an intermediate guide portion 22 and a bottom actuated means 23 for moving the top closure portion between opened and closed positions relative to a drain fitting 30 having a flange 31 which surrounds a drain bore 32 within which the intermediate guide portion 22 travels (FIGS. 3 and 4).

Figure 3:
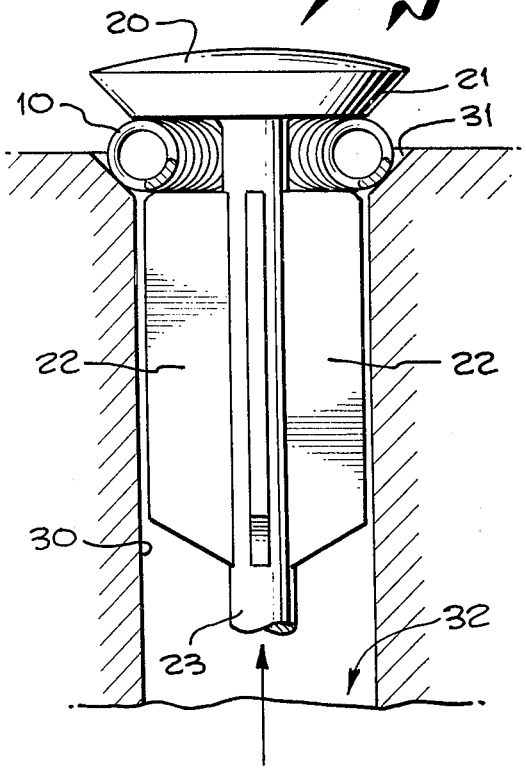
FIG. 3 is a side sectional view of an assembled device and stopper in a opened position adjacent a drain fitting bore.
Figure 4:
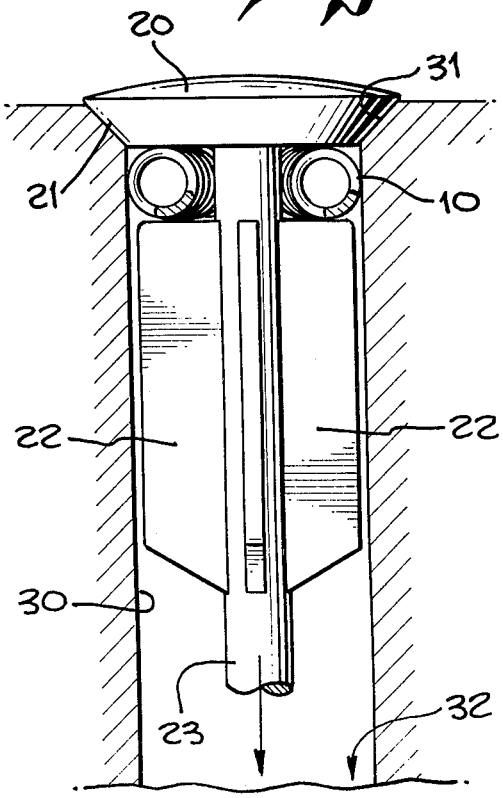
FIG. 4 is a side sectional view of an assembled device and a stopper in a closed position within a drain fitting flange.

In an exemplary embodiment, the device 10 is a screening means of toroidal configuration mounted upon the stopper 20 adjacent and below the top closure portion 21 to ride upon the intermediate guide portion 22 into the drain bore 32 upon closure of the stopper, and to ride out of the drain bore upon opening of the stopper (FIGS. 3 and 4). Screening means 10 fills a toroidal zone substantially between the outer marginal underside area of the top closure portion 21 and upper inner areas of the drain fitting flange 31 thereby screening drain bore 32 against the loss of objects therethrough when the stopper is in an opened position (FIG. 3).

The stopper 20 is raised to allow liquid waste to be drained from a plumbing fixture such as a sink, bathtub and the like (FIG. 3). As stopper 20 is raised, the device 10 is forced upward by the intermediate guide portion 22 of the stopper 20. Once the device 10 is raised to a position above and outside the interior portion of drain bore 32, the device partially obstructs and screens the drain opening 33, thereby allowing the plumbing fixture to be drained of liquid while at the same time preventing any solid objects from passing into the drain bore (FIG. 3).

The device is provided with elastic means for causing radial expansion and contraction of the toroidal configuration when the screening means 10 is alternately moved between positions outside of and within drain bore 32, as would occur when stopper 20 was raised and lowered (FIGS. 3 and 4).

In an exemplary embodiment, the toroidal device 10 for protecting against inadvertent loss of objects down drain bores comprises a coil spring having its free ends 11 and 12 connected together at the joint 13 thereby forming a closed toroidal configuration (FIG. 1).

A stopper 20 having a top closure portion 21 and an intermediate guide portion 22, for a drain fitting 30 having a flange 31 surrounding a drain bore 32, is provided with a coil spring means 10 having the free ends 11 and 12 thereof connected together, thereby forming a toroidal configuration which is connected to stopper 20 adjacent and below the top closure portion 21 such that the coil spring partially obstructs a toroidal zone between the top closure portion 21 and the drain fitting flange 31 when the stopper 20 is raised, whereby protection is provided against inadvertent loss of objects down the drain bore 32 (FIGS. 1, 2, 3 and 4).

In an exemplary embodiment, free ends 11 and 12 of coil spring 10 may be connected by any one of a plurality of methods such as welding, twisting, soldering and the like. Once the toroidal configuration is achieved, the device is forced past the top closure portion of the stopper into a position intermediate the top closure portion and the intermediate guide portion (FIG. 2). Upon lowering the stopper and coil spring into a closed position the coil spring device is compressed, by passing through flange 31, until coil spring 10 is entirely within drain bore 32 (FIG. 4). Upon raising stopper 20 to the open position, as when draining waste liquid from the plumbing fixture, coil spring 10 expands as the pressure from drain bore 32 and flange 31 is removed. The expanded coil spring 10 then partially obstructs the opening to drain bore 32 (FIG. 3).

It will be understood that various modifications and changes may be made in the configuration of the exemplary embodiment of the device described above which may come within the spirit of this invention and all such changes and modifications coming within the scope of the appended claims are embraced thereby.

I claim:

1. A device for protecting against inadvertent loss of objects down drain pipes when the associated drain stopper is in an opened position, said stopper having a top closure portion, an intermediate guide portion and a bottom actuated means for moving the top closure portion between opened and closed positions relative to a drain fitting having a flange surrounding a drain bore in which said intermediate guide portion travels, said device comprising in combination with a drain pipe, screening means of toroidal configuration for mounting about said stopper adjacent and below said top closure portion to ride on said intermediate guide portion into said drain bore upon closure of said stopper and, out of said drain bore upon opening of said stopper, to fill a toroidal zone substantially between outer marginal underside areas of said top closure portion and an upper inner area of said drain fitting flange, whereby said drain bore is screened against the loss of objects therethrough when said stopper is in an opened position.

2. The device of claim 1 wherein said screening means further comprises:

elastic means for causing radial expansion and contraction of said toroidal configurated screening means when the same is alternately moved between positions outside of and within said drain bore, as during routine raising and lowering of said stopper.

3. The device of claim 1 wherein said screening means comprises:

a coil spring having the free ends fixedly connected together in order to provide said toroidal configuration.

4. In a stopper having a top closure portion for a drain fitting having a flange surrounding a drain bore, the improvement in said stopper comprising the provision of:

coil spring means having the free ends thereof connected together forming a toroidal configuration connected to said stopper adjacent and below said top closure portion such that said coil spring means partially obstructs a toroidal zone between said top closure portion of said stopper and said drain fitting flange when said stopper is raised, whereby protection is provided against inadvertent loss of objects down said drain bore.

* * * * *